US011618020B2

(12) United States Patent
Jones

(10) Patent No.: US 11,618,020 B2
(45) Date of Patent: Apr. 4, 2023

(54) METERING ARRANGEMENT IN A CAPILLARY DRIVEN FLUID SYSTEM AND METHOD FOR THE SAME

(71) Applicant: miDiagnostics NV, Leuven (BE)

(72) Inventor: Benjamin Jones, Leuven (BE)

(73) Assignee: miDiagnostics NV, Leuven (BE)

( * ) Notice: Subject to any disclaimer, the term of this patent is extended or adjusted under 35 U.S.C. 154(b) by 87 days.

(21) Appl. No.: 16/607,670

(22) PCT Filed: Apr. 19, 2018

(86) PCT No.: PCT/EP2018/060070
§ 371 (c)(1),
(2) Date: Oct. 23, 2019

(87) PCT Pub. No.: WO2018/197337
PCT Pub. Date: Nov. 1, 2018

(65) Prior Publication Data

US 2020/0188917 A1 Jun. 18, 2020

(30) Foreign Application Priority Data

Apr. 24, 2017 (EP) ..... 17167678

(51) Int. Cl.
*B01L 3/00* (2006.01)
*B01F 33/30* (2022.01)

(52) U.S. Cl.
CPC ..... *B01L 3/502738* (2013.01); *B01F 33/30* (2022.01); *B01L 3/502715* (2013.01);
(Continued)

(58) Field of Classification Search
CPC .. B01L 3/502738; B01L 3/5027; B01L 3/502; B01L 3/50; B01L 3/502715; B01L 3/502746; B01L 2200/0605; B01L 2200/0621; B01L 2300/0867; B01L 2400/0406; B01L 2400/0487; B01L 2400/0688; B01F 13/0059; B01F 13/00
(Continued)

(56) References Cited

U.S. PATENT DOCUMENTS

2004/0209381 A1 10/2004 Peters et al.
2005/0249641 A1 11/2005 Blankenstein et al.
(Continued)

*Primary Examiner* — Christine T Mui
(74) *Attorney, Agent, or Firm* — Hodgson Russ LLP

(57) ABSTRACT

The disclosure relates to an arrangement (100) in a capillary driven fluid system for metering a predetermined volume of sample fluid. The arrangement comprises a sample reservoir (SR) arranged to receive a sample fluid, a first channel (C1) which is in fluid communication with the sample reservoir (SR) and which branches off into a second channel (C2) ending at a first valve (V1) and a third channel (C3) ending at a second valve (V2). The second channel (C2) and the third channel (C3) together have a predetermined volume, and the first channel (C1) is arranged to draw sample fluid from the sample reservoir (SR) by use of capillary forces to fill the second channel (C2) and the third channel (C3) with the predetermined volume of sample fluid. By selectively opening the first valve (V1) and the second valve (V2), a capillary driven flow may be formed, thereby causing the predetermined volume of sample fluid to flow out through the first valve (V1).

14 Claims, 6 Drawing Sheets

(52) U.S. Cl.
CPC . *B01L 3/502746* (2013.01); *B01L 2200/0605* (2013.01); *B01L 2200/0621* (2013.01); *B01L 2300/0867* (2013.01); *B01L 2400/0406* (2013.01); *B01L 2400/0487* (2013.01); *B01L 2400/0688* (2013.01)

(58) Field of Classification Search
USPC ..... 436/180; 422/502, 501, 500, 802
See application file for complete search history.

(56) References Cited

U.S. PATENT DOCUMENTS

2007/0189927 A1* 8/2007 Ballhorn ..... B01F 13/0059 422/68.1
2015/0056717 A1 2/2015 Zamir et al.

* cited by examiner

METERING ARRANGEMENT IN A CAPILLARY DRIVEN FLUID SYSTEM AND METHOD FOR THE SAME

FIELD OF THE INVENTION

Exemplary embodiments relate to an arrangement in a capillary driven fluid system for metering a predetermined volume of sample fluid and a method for the same.

BACKGROUND ART

Microfluidics deals with the behavior, precise control and manipulation of fluids that are geometrically constrained to a small, typically sub-millimeter, scale. Technology based on microfluidics are used for example in ink-jet printer heads, DNA chips and within lab-on-a-chip technology. In microfluidic applications, fluids are typically moved, mixed, separated or otherwise processed. In many applications, passive fluid control is used. This may be realized by utilizing the capillary forces that arise within the sub-millimeter tubes. By careful engineering of a so called capillary driven fluid system, it may be possible to perform control and manipulation of fluids.

Capillary driven fluid systems may be useful for metering or precisely measuring the volume of a fluid sample. One such application is in blood cell differentiation or counting, where the volume of the blood sample processed must be accurately known. In a system where a relatively large amount of blood (>10 mL) is added to a sample reservoir, it may not be desirable to process the entire sample of blood since only a minute quantity (<10 μL) is needed to get accurate statistics on the blood cell make-up. Therefore, the microfluidic system needs to measure off a known quantity of blood from the sample reservoir for processing. In a capillary-driven microfluidic system, metering is challenging because most existing capillary-based valve technologies do not allow for shutting or closing off a fluid stream once it has started. Therefore, a metered volume of fluid cannot simply be extracted from the sample reservoir by shutting off the flow to prevent too much sample from flowing into the system. Hence, there is a need for an improved arrangement in a capillary driven fluid system which may allow for precisely metering a predetermined volume of a sample fluid.

SUMMARY

Exemplary embodiments provide an arrangement which allows precise metering of a predetermined volume of a sample fluid using a capillary driven fluid system. The arrangement allows filling an initially empty space having a predetermined volume with sample fluid. The arrangement then allows removal of the metered sample fluid from the space by means of a buffer fluid that fills the space as the metered sample fluid is sucked out by capillary forces from the space. The metered sample fluid may then, together with parts of the buffer fluid, enter a secondary system, such as for example a diagnostic system, for allowing measuring characteristics of the sample fluid.

BRIEF DESCRIPTIONS OF THE DRAWINGS

The above, as well as additional features and advantages, will be better understood through the following illustrative and non-limiting detailed description of several embodiments described herein, with reference to the appended drawings, where the same reference numerals will be used for similar elements, wherein.

DETAILED DESCRIPTION

Figure 1:
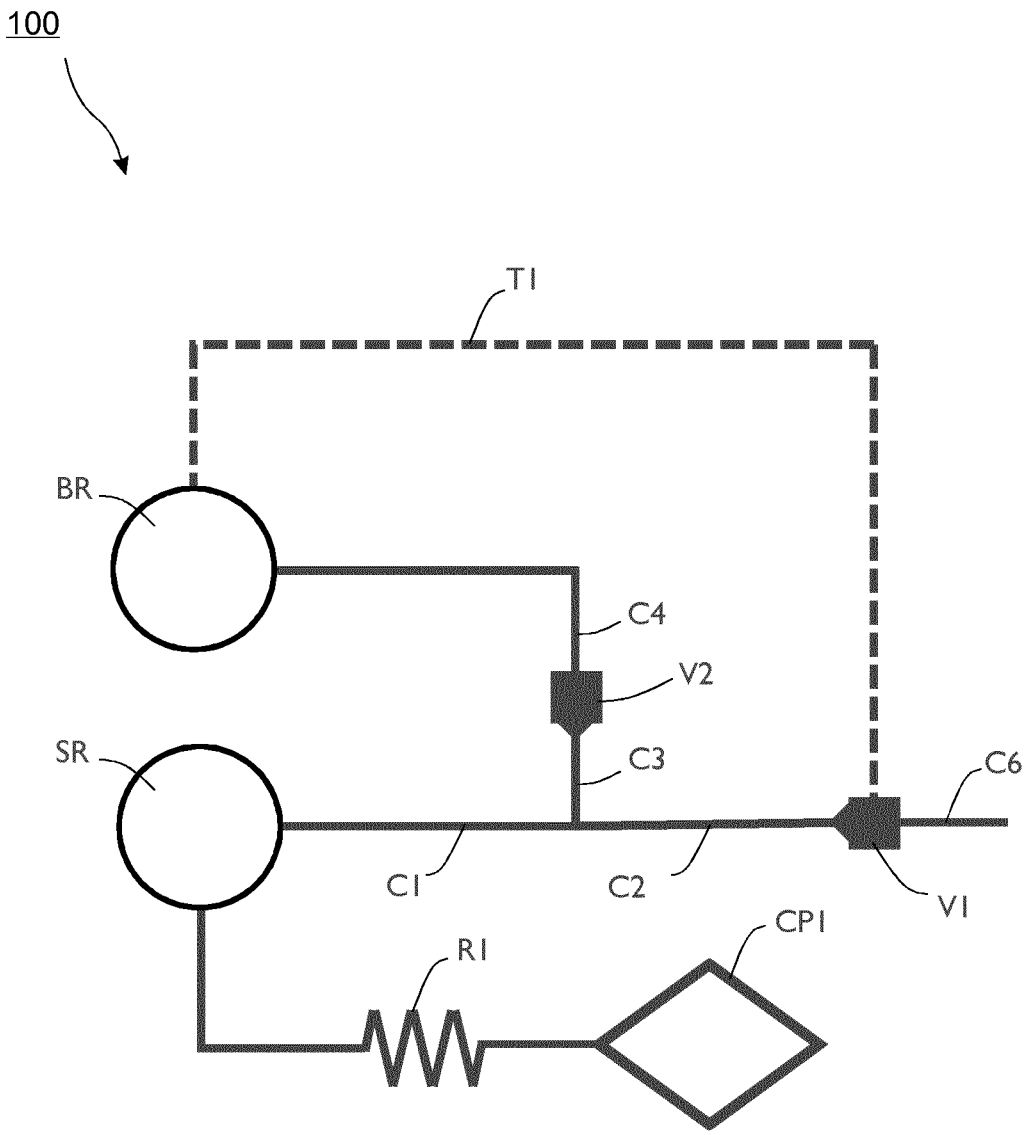
FIG. 1 shows a schematic circuit diagram of an arrangement in a capillary driven fluid system according to embodiments of the present disclosure.

It is an object to provide an improved arrangement in a capillary driven fluid system for metering a predetermined volume of sample fluid.

According to a first aspect, these and other problems are solved in full, or at least in part, by an arrangement in a capillary driven fluid system for metering a predetermined volume of sample fluid, the arrangement comprising: a sample reservoir arranged to receive a sample fluid, a first channel which is in fluid communication with the sample reservoir and which branches off into a second channel ending at a first valve and a third channel ending at a second valve, wherein the second channel and the third channel together have a predetermined volume, and the first channel is arranged to draw sample fluid from the sample reservoir by use of capillary forces to fill the second and the third channel with the predetermined volume of sample fluid, a capillary pump arranged to empty the sample reservoir after the second channel and the third channel have been filled with sample fluid, a buffer reservoir arranged to receive a buffer fluid, a fourth channel, wherein the second valve is fluidically connected to the buffer reservoir via the fourth channel, the fourth channel being arranged to draw buffer fluid from the buffer reservoir by use of capillary forces after the sample reservoir has been emptied, and to open the second valve as buffer fluid in the fourth channel reaches the second valve, whereby a fluid path including the fourth channel, the third channel and the second channel is opened up from the buffer reservoir to the first valve, and a first control circuit arranged to open the first valve after the sample reservoir has been emptied, whereby a capillary driven flow arises in said fluid path, thereby causing the predetermined volume of sample fluid in the second and third channels to flow out through the first valve.

This arrangement achieves a precise metering of a sample fluid by allowing a number of steps to be performed in a predetermined timing sequence. An initial step is to completely fill an initially empty space of a predetermined volume with sample fluid. The space constitutes the second channel and the third channel. Thus, the predetermined volume will be the combined volume of the second channel and the third channel. A next step is to allow removal of the metered sample fluid from the space by means of a buffer fluid that fills the space while capillary forces suck the metered sample fluid out from the space. The metered sample fluid may then, together with parts of the buffer fluid, enter a secondary system, such as for example a diagnostic system, for allowing measuring characteristics of the sample fluid. In order for the arrangement to work, a number of additional steps are also required, as will be further detailed hereinbelow.

The proposed arrangement is advantageous as it allows precise metering of sample fluid to be achieved without active control. This simplifies the arrangement as is may be operable without including control units and/or external power sources. Thus, the arrangement may be useful in handheld devices intended to be used in the field. The steps may be allowed to be activated at different time with respect to each other by means of carefully designing the arrangement such as to allow fluid movement to occur in a predetermined way. Fluid may then be arranged to reach predetermined positions in the fluid system at predetermined times. At said positions, the fluid may be further arranged to actuate valves such as to allow changing the way the arrangement operates, for example by opening up new fluid paths in the fluid system. The arrangement may be operated solely by means of capillary forces acting on the fluids in channels of the arrangement and using existing microfluidic valve technology. Specifically, the present disclosure provides a way to perform accurate metering of a sample volume using a microfluidic system comprising microfluidic valves without having to close any one of the valves.

Sample fluid should be understood as any fluid that is to be metered using the arrangement. The sample fluid may be metered as a preparatory step before characterizing the sample fluid in terms of one or more of its properties, such as measuring the concentration of substituents in the sample fluid. A sample fluid may be for example blood. Alternatively, it may be a chemical compound in liquid form. It may also be a mix of solid and liquids, such as for example a powder dispersed in a liquid.

Buffer fluid should be understood as any fluid that is suitable for filling a space as the metered sample fluid is sucked out by capillary forces from the space. The buffer fluid may for example be sodium chloride (NaCl) dissolved in water or phosphate buffered saline (PBS) solution.

In some cases, the buffer fluid may be a fluid that reacts with the sample fluid. An example system could consist of a sample fluid containing an analyte that needs to be measured and the buffer fluid contains a fluorescent molecule that fluoresces strongly when bound to the analyte and weakly otherwise. After mixing the sample and buffer fluids, a fluorescence intensity measurement can be made to see how much analyte is contained within the metered volume of the sample.

According to an embodiment, the first control circuit comprises a first fluidic circuit which fluidically connects the first valve to the buffer reservoir, the first fluidic circuit being arranged to draw buffer fluid from the buffer reservoir and open the first valve as buffer fluid reaches the first valve. An example of a suitable valve technology for this embodiment is a capillary trigger valve, which stops the advancement of the liquid-vapor interface by an abrupt change in geometry preventing further wetting of the liquid and is actuated by the fluidic control circuit to restart the advancement of the liquid-vapor interface past the abrupt change in geometry. The use of a fluidic circuit for opening the first valve may be an advantage as it allows the arrangement to be made in a simplified way. Specifically, there is no need of introducing control circuits and/or systems based on another technology, such as for example electronics and/or electromechanics. The arrangement may instead be realized by means of a circuitry purely based on microfluidics.

According to an embodiment, the arrangement further comprises a third valve fluidically connected to the fourth channel such that buffer fluid drawn from the buffer reservoir passes through the third valve before entering the fourth channel, and a second control circuit which is arranged to open the third valve after the sample reservoir has been emptied. The introduction of a third valve may allow an improved control of timing of the arrangement. Specifically, buffer fluid may be administered to the buffer reservoir at any time. Buffer fluid will then be allowed to fill the fourth channel but the buffer fluid cannot go beyond the third valve. Buffer fluid is then introduced at the appropriate time by selectively opening the third valve.

According to an embodiment, the second control circuit comprises a second fluidic circuit which fluidically connects the third valve to the buffer reservoir, the second fluidic circuit being arranged to draw buffer fluid from the buffer reservoir and open the third valve as buffer fluid reaches the third valve. The second control circuit is used for controlling the third valve. This implies that the third valve may be opened by the second control circuit. As for the first control circuit, the advantage of using a second fluidic circuit is a simplified solution as the arrangement may be realized by means of circuitry purely based on microfluidics.

According to an embodiment, at least one of the first control circuit and the second control circuit is arranged to deliver an electrical control signal to at least one of the first valve and the second valve, wherein at least one of the first valve and the second valve is arranged to open upon receipt of the electrical signal. As an example, the valve technology could be an electrically-actuated capillary stop. The valve stops the advancing liquid-vapor interface by an abrupt change in geometry that prevents further wetting by the liquid. The fluid is then actuated by using an electrode that advances the liquid vapor interface through electrostatic forces past the abrupt change in geometry allowing the liquid vapor interface to proceed further downstream of the valve. This alternative embodiment may be an advantage for some applications as it allows for adjusting the timing. A purely microfluidic system most often has a predetermined design, which specifically means that delay timing etc. will not be possible to adjust once the arrangement has been designed.

According to an embodiment, the first control circuit is arranged to open the first valve simultaneously with or after an opening of the second valve. Opening the first valve simultaneous with the second valve may allow the sample fluid residing within the second channel and the third channel to flow out from the third valve. Alternatively, the first valve may be opened after the second valve to allow prefilling of the system downstream from the first valve with the buffer fluid before the second valve is actuated.

According to an embodiment, the first channel is fluidically connected to the sample reservoir so as to draw sample fluid directly from the sample reservoir, and wherein the capillary pump is fluidically connected to the sample reservoir via a first flow resistor, wherein the first flow resistor has a flow resistance which is selected to control the flow rate from the sample reservoir to the capillary pump such that the sample reservoir is emptied after the second and third channels have been filled with sample fluid. By having a fluid connection between the sample reservoir and the capillary pump at all times allows for further simplifying the arrangement, as no additional valves or the like will be needed. The first flow resistor may be advantageous as it allows for controlling the flow rate such that sample reservoir is not emptied too fast, i.e., before the metered channels (the second and third channels) are filled with sample fluid.

According to an embodiment, the arrangement further comprises a fifth channel of lower capillary pressure than the first channel, wherein the first channel is arranged as a branch to the fifth channel such that the first channel is arranged to draw fluid from the sample reservoir via the fifth channel, wherein the capillary pump is fluidically connected to the sample reservoir via a path which includes the fifth channel and which includes a flow restrictor such that the capillary pump is arranged to empty the sample reservoir via the fifth channel after the second channel and the third channel have been filled with sample fluid. The alternative embodiment may be advantageous as it may reduce the risk that the sample reservoir is emptied by the capillary pump before the second and third channels have been completely filled, a situation which would result in an inaccurate metering. Additionally, the alternative embodiment may provide the desired functionality without having to use dual connections to the sample buffer, thus simplifying the geometrical layout.

The arrangement may be fabricated using a variety of different methods. One possibility is to use silicon microfabrication technology. Using such a technology allows for forming a complete microfluidic arrangement on a chip, thus allowing for lab-on-a-chip solutions. A two-step deep reactive ion etching process may be used. The use of such a process may allow forming channels of two different depths beneficial for creating reliable capillary valve structures. The top surface of the channels, or the whole arrangement, may either be open or closed with a top cover. Specifically, according to an embodiment, the sample fluid and/or the buffer fluid at least partly is in gaseous communication with surroundings of the arrangement such as to allow gas mixed within the sample fluid and/or buffer fluid to escape from the arrangement. This may be advantageous as it allows a design where gas is not trapped in the system. Such a design may be an open fluidics design. Specifically, according to an embodiment, the gaseous communication with surroundings occur through a gas permeable sheet. Thus, the top cover may be a gas permeable sheet that allows the flow of gas but not liquid. In the case of a gas permeable sheet, the contact angle may not be too low so as to cause premature failure of the capillary valves. The open fluidic or gas permeable sheet permits gas to escape as the liquid vapor interface proceeds through the device without trapping air.

According to an embodiment, the gaseous communication with surroundings occurs through one or more further valves fluidically connected to one or more from: the first valve and the second valve, said one or more further valves being arranged to allow gas to pass while blocking liquids. Each of the one or more further valves may further be fluidically connected to a vent. This may allow gas that passed through the valve to exit from the system. This may be advantageous in a case where an open fluidic design is a less good alternative. The contact angle of the liquid vapor interface should not be too low so as to cause premature failure of the capillary valves. Therefore, said one or more further valves must be arranged to allow the gas to escape as the liquid approaches.

According to an embodiment, the predetermined volume of sample fluid flowing out through the first valve is received by a sixth channel ending at a fourth valve, wherein the fourth valve is arranged to dilute the predetermined volume of sample fluid received from the sixth channel with buffer fluid received from the buffer reservoir via a second flow resistor so as to create a diluted sample fluid, wherein the fourth channel comprises a third flow resistor, and wherein a ratio between a flow rate of sample fluid received from the sixth channel and a flow rate of the buffer fluid received from the buffer reservoir is at least partly determined by a resistance of the second flow resistor and a resistance of the third flow resistor. This may be advantageous as it allows for outputting the predetermined sample fluid in diluted form, wherein the dilution ratio may be known. This may be beneficial for some applications, such as when performing cell counting, wherein the cell number concentration in an undiluted sample fluid may be too large for providing accurate readings.

In the embodiment, the mix ratio between the sample fluid in the sample reservoir and the buffer fluid in the buffer reservoir is primarily determined by the resistance of resistor elements R2 and R3 assuming that the resistance of all other channels is negligible. The flow resistors may be arranged differently than disclosed hereinabove. Specifically, the third flow resistor may be arranged downstream of the first valve, for example on the sixth channel. In such a case, the viscosity of the buffer fluid and/or the sample fluid may also have an effect on the dilution ratio.

According to an embodiment, the arrangement further comprises a mixer which is fluidically connected to an output of the fourth valve and which is arranged to mix the diluted sample fluid, and a further capillary pump in fluid communication with the mixer, the further capillary pump being arranged to sustain a flow rate of the diluted sample fluid through the mixer. The use of a mixer further aids in providing a homogenous mix of sample fluid and buffer fluid. This may be beneficial for some applications, such as when performing cell counting, wherein an inhomogeneous mix may result in local regions where the cell number concentration is too large for providing accurate readings.

Specifically, the arrangement may further comprise a counting detector which is fluidically connected to an output of the mixer and to the further capillary pump, such that diluted sample fluid output from the mixer is transported through the counting detector on its way to the further capillary pump. One example of such a counting detector is a cell counting detector. The cell counting detector may be arranged to count, e.g., red blood cells present within a diluted blood sample.

According to a second aspect, there is provided a method for metering a predetermined volume of sample fluid, the method comprising the steps of:

adding sample fluid to a sample reservoir, setting a first channel in fluid communication with the sample reservoir, such that the first channel draws sample fluid from the sample reservoir, by use of capillary forces, to fill a second channel and a third channel, which are branches of the first channel, with a predetermined volume of sample fluid, wherein the second channel ends at a first valve and the third channel ends at a second valve, after the second channel and the third channel have been filled with the predetermined volume of sample fluid: emptying the sample reservoir by removing sample fluid using a capillary pump, after the sample reservoir has been emptied: setting the second valve in fluid communication with a buffer reservoir filled with buffer fluid via a fourth channel, such that the fourth channel draws buffer fluid from the buffer reservoir by use of capillary forces, and opens the second valve as buffer fluid in the fourth channel reaches the second valve, whereby a fluid path including the fourth channel, the third channel and the second channel is opened up from the buffer reservoir to the first valve, and opening, by a first control circuit, the first valve, whereby a capillary driven flow arises in said fluid path, thereby causing the predetermined volume of sample fluid in the second and third channels to flow out through the first valve.

According to a third aspect, there is provided a diagnostic device comprising the arrangement according to the first aspect. For example, the arrangement of the first aspect may be implemented in a cartridge that is usable with a handheld device for diagnostic purposes.

Effects and features of the second and third aspects are largely analogous to those described above in connection with the first aspect. Embodiments mentioned in relation to the first aspect are largely compatible with the second aspect and third aspects. It is further noted that the inventive concepts relate to all possible combinations of features unless explicitly stated otherwise.

Various embodiments will now be described more fully hereinafter with reference to the accompanying drawings. The inventive concepts may, however, be embodied in many different forms and should not be construed as limited to the embodiments set forth herein; rather, these embodiments are provided for thoroughness and completeness, and fully convey the scope of the inventive concepts to the skilled person.

Referring to FIG. 1, an arrangement 100 in a capillary driven fluid system for metering a predetermined volume of sample fluid will now be described in detail. The arrangement may typically be a part of a chip with etched structures, such as channels, cavities etc.

The arrangement 100 comprises a sample reservoir SR arranged to receive a sample fluid. The sample fluid may be for example blood from a patient. However, the sample fluid may be any kind of fluid of interest, such as a chemical compound in liquid form, a powder dispersed in a liquid etc. The arrangement 100 further comprises a first channel C1 which is in fluid communication with the sample reservoir SR. The first channel C1 branches off into a second channel C2 and a third channel C3. The second channel C2 ends at a first valve V1 and the third channel C3 ends at a second valve V2, respectively. The second channel C2 and the third channel C3 together have a predetermined volume. In other words, the arrangement will be able to meter a volume of sample fluid which is the sum of the volume of the second channel C2 and the volume of the third channel C3 of the sample fluid. This implies that metered volume (i.e. the predetermined volume) is fixed once the channels C2 and C3 are designed.

The first channel C1 is arranged to draw sample fluid from the sample reservoir SR by use of capillary forces to fill the second channel C2 and the third channel C3 with the predetermined volume of sample fluid.

The arrangement 100 further comprises a capillary pump CP1 arranged to empty the sample reservoir SR after the second channel C2 and the third channel C3 have been filled with sample fluid. Capillary pumps may be realized in different ways. A simple capillary pump is a microchannel having a sufficient volume to accommodate the volume of liquid that needs to be displaced in a specific case. Another simple capillary pump is a cavity, which may be filled with posts, pillars, packed beads, or some other porous structure to generate a sufficient capillary force while having a large enough volume to accommodate the application. Capillary pressure in the capillary pump may be increased by use of smaller parallel microchannels.

In the embodiment, the first channel C1 is fluidically connected to the sample reservoir SR so as to draw sample fluid directly from the sample reservoir. Furthermore, the capillary pump CP1 is fluidically connected to the sample reservoir SR via a first flow resistor R1. The first flow resistor R1 has a flow resistance which is selected to control the flow rate from the sample reservoir SR to the capillary pump CP1 such that the sample reservoir SR is emptied after the second C2 and third C3 channels have been filled with sample fluid. In other words, the first flow resistor R1 has been designed so that the sample reservoir SR is emptied of sample fluid after sufficient time has been given for the sample fluid to completely fill the metered volume of the second channel C2 and the third channel C3.

The arrangement 100 further comprises a buffer reservoir BR arranged to receive a buffer fluid. In this embodiment, the buffer fluid must be added to the buffer reservoir after the sample reservoir has been emptied of sample fluid. The buffer fluid may be for example phosphate buffered saline (PBS) solution.

The arrangement 100 further comprises a fourth channel C4. The fourth channel C4 is arranged such that the second valve V2 is fluidically connected to the buffer reservoir BR via the fourth channel C4. The fourth channel C4 is thus arranged to draw buffer fluid from the buffer reservoir BR by use of capillary forces after the sample reservoir SR has been emptied. The fourth channel C4 is further arranged to open the second valve V2 as buffer fluid in the fourth channel C4 reaches the second valve V2. The opening of the second valve V2 will allow a fluid path to open up. The fluid path includes the fourth channel C4, the third channel C3 and the second channel C2. The fluid path is opened up from the buffer reservoir BR to the first valve V1.

The arrangement 100 further comprises a first control circuit T1 arranged to open the first valve V1 after the sample reservoir SR has been emptied. This will allow for a capillary driven flow to arise in the fluid path, thereby causing the predetermined volume of sample fluid in the second C2 and third C3 channels to flow out through the first valve V1. The first control circuit may be in the form of a first fluidic circuit T1 which fluidically connects the first valve V1 to the buffer reservoir BR. The first fluidic circuit T1 is arranged to draw buffer fluid from the buffer reservoir BR and open the first valve V1 as buffer fluid reaches the first valve V1. The first fluidic circuit may be one or more further channels fluidically connecting the buffer reservoir BR with the first valve V1. If dilution of the metered volume in the second C2 and the third channel C3 is not desired, the resistance of the first fluidic circuit shall be much higher than the resistance of the combination of the channels C2, C3 and C4.

The timing of the arrangement works as follows. The first valve V1 and the second valve V2 are opened after the second channel C2 and the third channel C3 has been filled with sample fluid and after the remaining sample fluid of the sample reservoir SR has been completely emptied by the capillary pump CP1. The process of emptying the sample reservoir will, in turn, depend on the time needed for the entire volume of the sample fluid in the sample reservoir SR to flow into the capillary pump CP1, a process which will depend on the flow resistor R1. Hence, it is understood that the arrangement may require careful design of more than one part of the system such that each of these parts provide a fluid transport speed relating to the fluid transport speed of the other parts in a way that enables the steps to occur following a desirable timing sequence. Once the predetermined volume of sample fluid in the second C2 and third C3 channels has been allowed to flow out through the first valve V1, they enter a sixth channel C6. The sixth channel C6 may be fluidically connected to an external system arranged to receive the metered sample fluid. Such an external system may be for example a measurement device arranged to determine characteristics of the sample fluid, such as the concentration of the sample fluid or concentration of substituents in the sample fluid.

The valves described herein (such as the first valve V1 and the second valve V2) may generally be of different kinds. However, in the embodiment, the valves are microfluidic valves, so called capillary trigger valves, which are arranged to open up for passage of a fluid entering the valve through a main input upon the valve being reached by a control fluid entering the valve through a separate control input.

Figure 2:
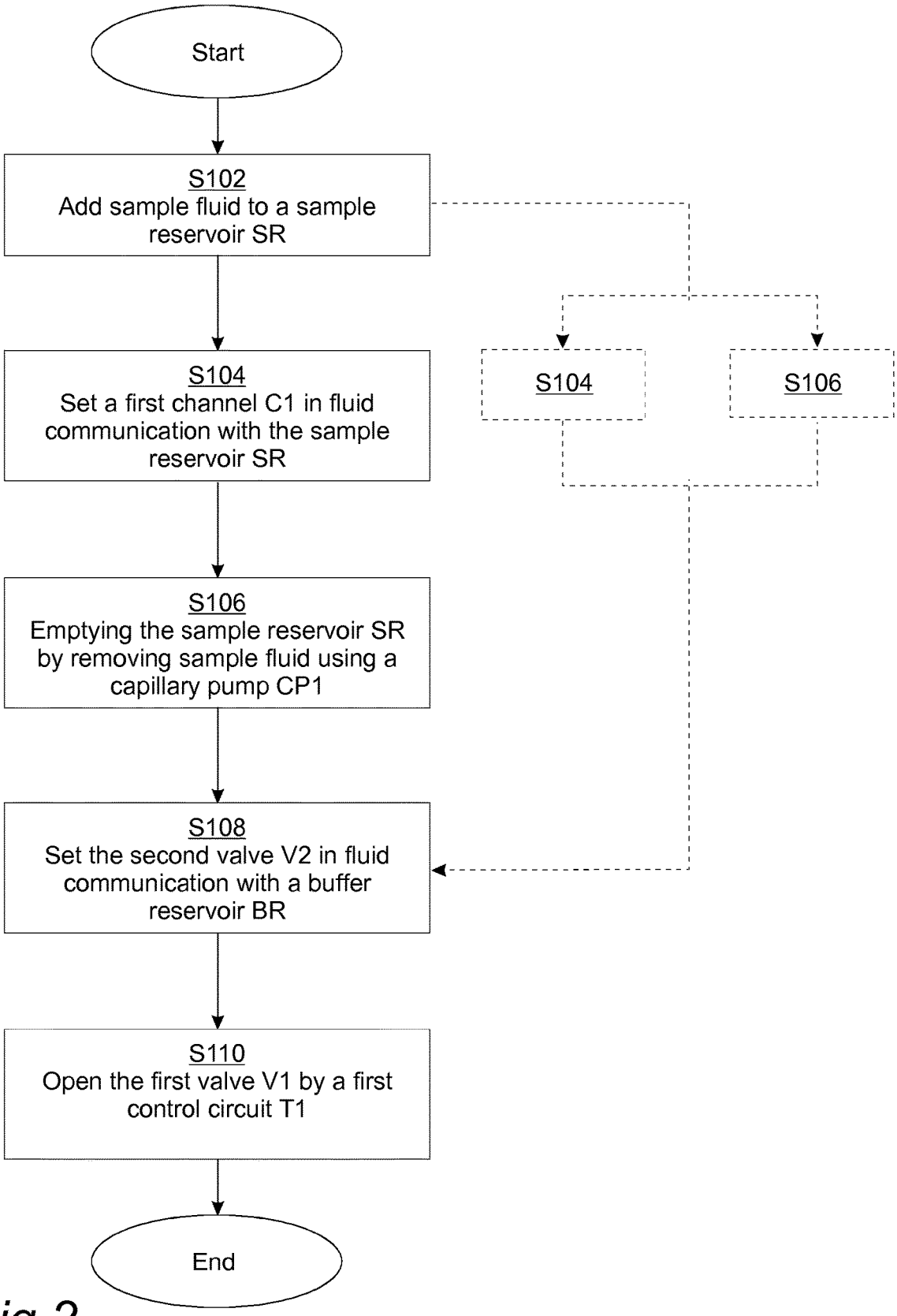
FIG. 2 shows a flow chart of a method for metering a predetermined volume of sample fluid using an arrangement according to embodiments of the present disclosure.

A method for metering a predetermined volume of sample fluid will now be further described with reference to FIG. 1 and the flow chart of FIG. 2. However, it is to be understood that the method may equally well be applicable to any other embodiment of the arrangement disclosed herein.

In a first step, S102, sample fluid is added to the sample reservoir SR. The sample fluid may for example be blood.

In a second step, S104, the first channel C1 is set in fluid communication with the sample reservoir SR. Upon doing so, the first channel C1 will draw sample fluid from the sample reservoir SR, by use of capillary forces, to fill the second channel C2 and the third channel C3, which are branches of the first channel C1, with a predetermined volume of sample fluid. At this stage, the first valve V1 and the second valve V2 are closed, thereby causing the sample fluid to stop once the it reaches the first valve V1 and the second valve V2, respectively.

It should be noted that, for the arrangement 100, the second step S104 may occur naturally as a result from adding the sample fluid to the sample reservoir SR in the first step S102. For alternative embodiments, the second step may have to be actively executed, e.g., by opening a valve or similar.

In a third step, S106, the sample reservoir SR is emptied by removing sample fluid using a capillary pump CP1. The third step S106 may run in parallel with the second step S104 as illustrated by the dashed lines in FIG. 2. For example, referring to FIG. 1, the capillary pump CP1 may, via capillary forces, remove sample fluid from the sample reservoir via flow resistor R1 at the same time as the second C2 and third channels C3 are filled with sample fluid via the first channel C1. In that case, the flow resistance R1 to the capillary pump CP1 should be selected such that the sample reservoir SR is not emptied too fast, i.e., the flow resistance should be large enough so that the metered channels C2 and C3 are completely filled before the sample reservoir is emptied. In other embodiments, such as when the setup of FIG. 5 for emptying the sample reservoir SR is used, steps S104 and S106 are rather sequential in that the metered channels C2 and C3 are filled before the capillary pump CP1 starts to empty the sample reservoir SR.

After the sample reservoir SR has been emptied by the capillary pump CP1 a fourth step S108 is initiated. In the fourth step, S108, the second valve V2 is set in fluid communication with a buffer reservoir BR which is filled with buffer fluid via a fourth channel C4. Upon doing so, the fourth channel C4 starts to draw buffer fluid from the buffer reservoir BR by use of capillary forces, and opens the second valve V2 as buffer fluid in the fourth channel C4 reaches the second valve V2. At this stage, a new fluid path of low resistance is thus opened up in the arrangement from the buffer reservoir BR to the first valve V1. The new fluid path includes the fourth channel C4, the third channel C3 and the second channel C2.

It should be noted that, for the arrangement 100, the second valve V2 is in fluid communication with the buffer reservoir BR at all times. Thus, the fourth step S108 may have to be initiated by adding buffer fluid to the buffer reservoir BR at a specific time. This will ensure that the second valve V2 is set in fluid communication with the buffer reservoir BR which is filled with buffer fluid via a fourth channel C4. For alternative embodiments, the second step may be actively executed, e.g., by actuating a further valve as will be described in connection to FIGS. 3-6. In such a case, buffer fluid may be present in the buffer reservoir BR at all times.

In a fifth step, S110, the first valve V1 is opened by a first control circuit T1. Upon doing so, a capillary driven flow arises in the newly opened fluid path C4-C3-C2. At this stage, buffer fluid from the buffer reservoir BR will replace the sample fluid in the metered channels C3 and C2 as the metered volume of sample fluid is drawn out by capillary forces into channel C6. In that way the predetermined volume of sample fluid in the second channel C2 and the third channel C3 is caused to flow out through the first valve V1. The second channel C2 and the third channel C3 are replenished by the buffer fluid while the predetermined volume of sample fluid is transporter further downstream of the capillary system.

The control of the timing will allow to control the operation of the arrangements such that the second valve V2 does not open until after the sample fluid has reached, and filled, the second channel C2 and the third channel C3, and the sample reservoir SR has been emptied. Otherwise, one may arrive at a situation where, in the end, additional sample fluid is drawn from the sample reservoir SR via the first channel C1 and out through the first valve V1. In other words, neither of the valves V1 and V2 should be opened before the metered channels C2 and C3 are filled and the sample reservoir SR has been emptied. Alternative timing of the opening of valve V1 relative to the opening of the valve V2 may be used. However, preferably, the control circuit is arranged to open the first valve V1 simultaneously with or after the second valve V2.

In the FIG. 1 embodiment, the opening of the second valve V2 is controlled by the buffer fluid, and it is for practical reasons preferred to have the buffer reservoir BR empty at the start of the metering process. Once it is established that the sample fluid has successfully filled the second channel C2 and the third channel C3 and the sample reservoir SR has been emptied of sample fluid via the capillary pump CP1, the buffer fluid may be administered to the buffer reservoir BR, whereby buffer fluid may be allowed to reach the second valve V2 by means of capillary driven flow in the fourth channel C4.

Figure 3:
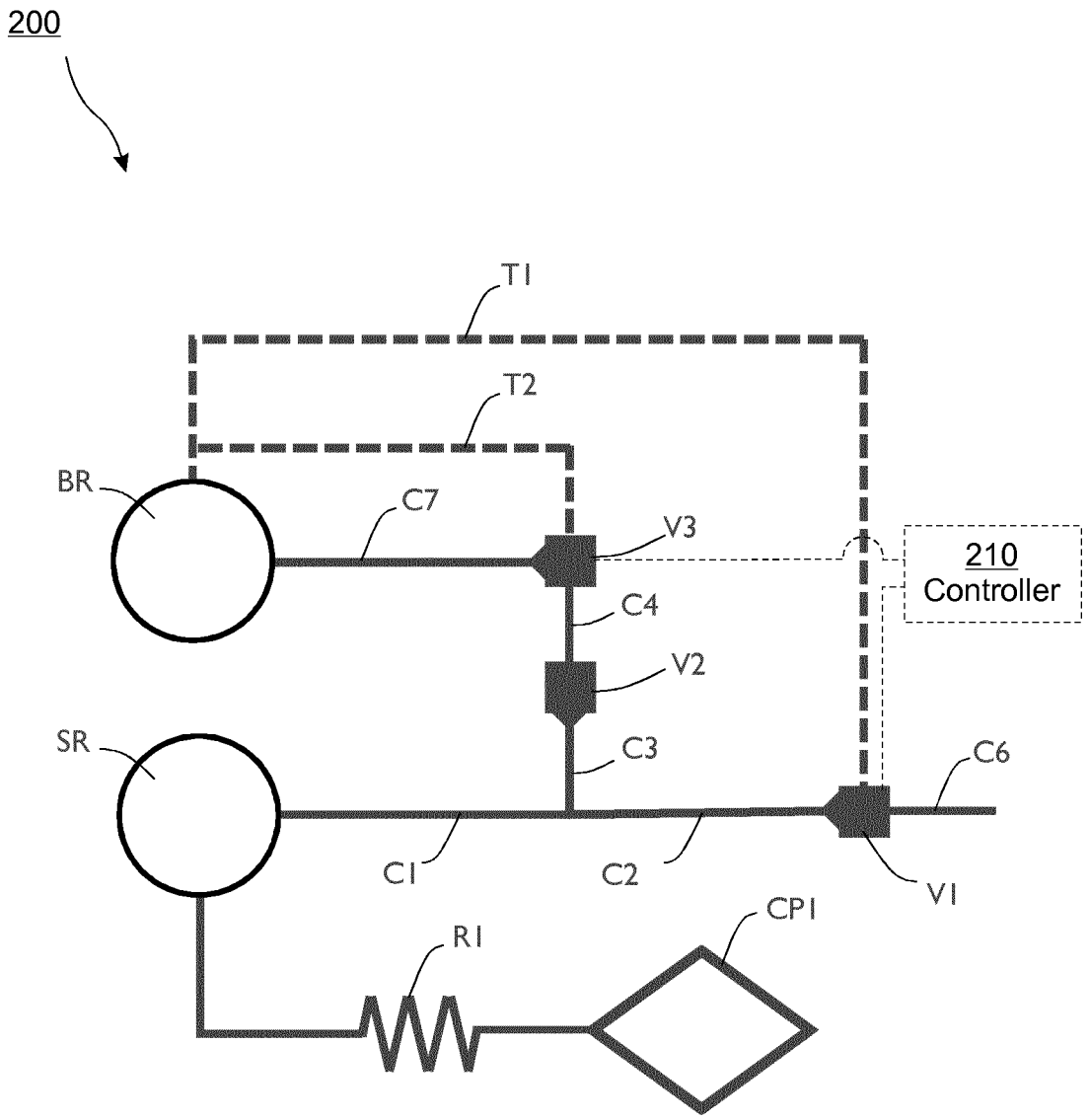
FIG. 3 shows a schematic circuit diagram of an arrangement in a capillary driven fluid system according to embodiments of the present disclosure.

However, in other embodiments, improved timing control may be obtained if adding a mean which actively controls when buffer fluid reaches the second valve V2. An embodiment comprising such a scheme is shown in FIG. 3. The arrangement 200 of FIG. 3 differs from the arrangement 100 in that it further comprises a third valve V3 fluidically connected to the fourth channel C4 such that buffer fluid drawn from the buffer reservoir BR passes through the third valve V3 before entering the fourth channel C4. The arrangement 200 further comprises a second control circuit T2 which is arranged to open the third valve V3 after the sample reservoir SR has been emptied.

Similarly, as for the first control circuit T1, the second control circuit in the arrangement 200 may comprise a second fluidic circuit T2. The second fluidic circuit T2 fluidically connects the third valve V3 to the buffer reservoir BR. The second fluidic circuit T2 is arranged to draw buffer fluid from the buffer reservoir BR and open the third valve V3 as buffer fluid reaches the third valve V3. The second fluidic circuit T2 may be one or more further channels fluidically connecting the buffer reservoir BR with the third valve V3.

The timing of the opening of the third valve V3 by the second control circuit T2 will now be discussed. Preferably, the second valve V2 may not be opened until after the sample reservoir SR has been emptied. The correct timing may be achieved by carefully designing the second fluidic circuit T2 such that the time needed for the buffer fluid to reach all the way from the buffer reservoir BR to the third valve V3 is sufficient to allow for the second valve V2 to open after the sample fluid has been emptied from the sample reservoir SR. The first control circuit T1 may be arranged to open the first valve V1 simultaneously with or after an opening of the second valve V2. As previously mentioned, this implies that different parts of the arrangement must be designed such that the fluid flow speed in the different parts relate to each other in a specific way for the arrangement to work as intended. Specifically, this may be realized by using different channel lengths, different channel cross sections etc.

In the embodiments of FIGS. 1 and 3, the first control circuit T1 and the second control circuit T2 were microfluidic channels. The first valve V1 and the third valve V3 are thus controlled by buffer fluid reaching the first valve V1 and the third valve V3 respectively, i.e. they are microfluidic, capillary trigger valves. Alternatively, the opening of the first valve V1 and the third valve V3 may be electrically controlled. In more detail, at least one of the first control circuit T1 and the second control circuit T2 may be arranged to deliver an electrical control signal to at least one of the first valve V1 and the second valve V2, wherein the at least one of the first valve V1 and the second valve V2 is arranged to open upon receipt of the electrical signal. For this purpose, the arrangement may further comprise a controller, e.g., in the form of a microcontroller, which is electrically coupled to the first valve V1 and/or the third valve V3. This implies that the first valve V1 and the third valve V3 may be of another type of microfluidic valve. Different electrically-actuated valve mechanisms exist, such as those based on electromagnetic or electrostatic forces, expansion of conductive polymers, etc. The controller is illustrated as item 210 in FIG. 3, but could of course be included in any other of the arrangements 100, 200, 300, 400, 500 shown herein in the same manner. The microcontroller can either be integrated into the same fluidic chip as the arrangement 100, 200, 300, 400, 500, or be a seperate silicon chip. Sensors may also be integrated into the silicon fluidic chip of the arrangement 100, 200, 300, 400, 500 to serve as inputs to the microcontroller, which in turn actuates the valves V1 and/or V3 in response to the sensor inputs. For instance, a sensor may sense when there is liquid in a certain region of a chip and the microcontroller can actuate the valve in response to that signal. The sensors can be either capacitance, impedance, optical, or other.

The arrangement may be fabricated using a variety of different methods. One possibility is using silicon microfabrication technology. A two-step deep reactive ion etching process may be used. The use of such a process may allow forming channels of two different depths for creating reliable capillary valve structures. The top surface of the channels of the whole arrangement may either be open or closed with a top cover. Specifically, in the embodiments shown in FIGS. 1 and 3, the sample fluid and/or the buffer fluid at least partly is in gaseous communication with surroundings of the arrangement 100, 200 such as to allow gas trapped within the sample fluid and/or buffer fluid to escape from the arrangement 100, 200. For example, the top surface may be covered by a gas permeable sheet. The gas permeable sheet forms a top cover that allows gas but not liquid to escape. The contact angle may not be too low so as to cause premature failure of the capillary valves. The open fluidic or gas permeable sheet permits gas to escape as the liquid vapor interface proceeds through the channels without trapping air.

Figure 4:
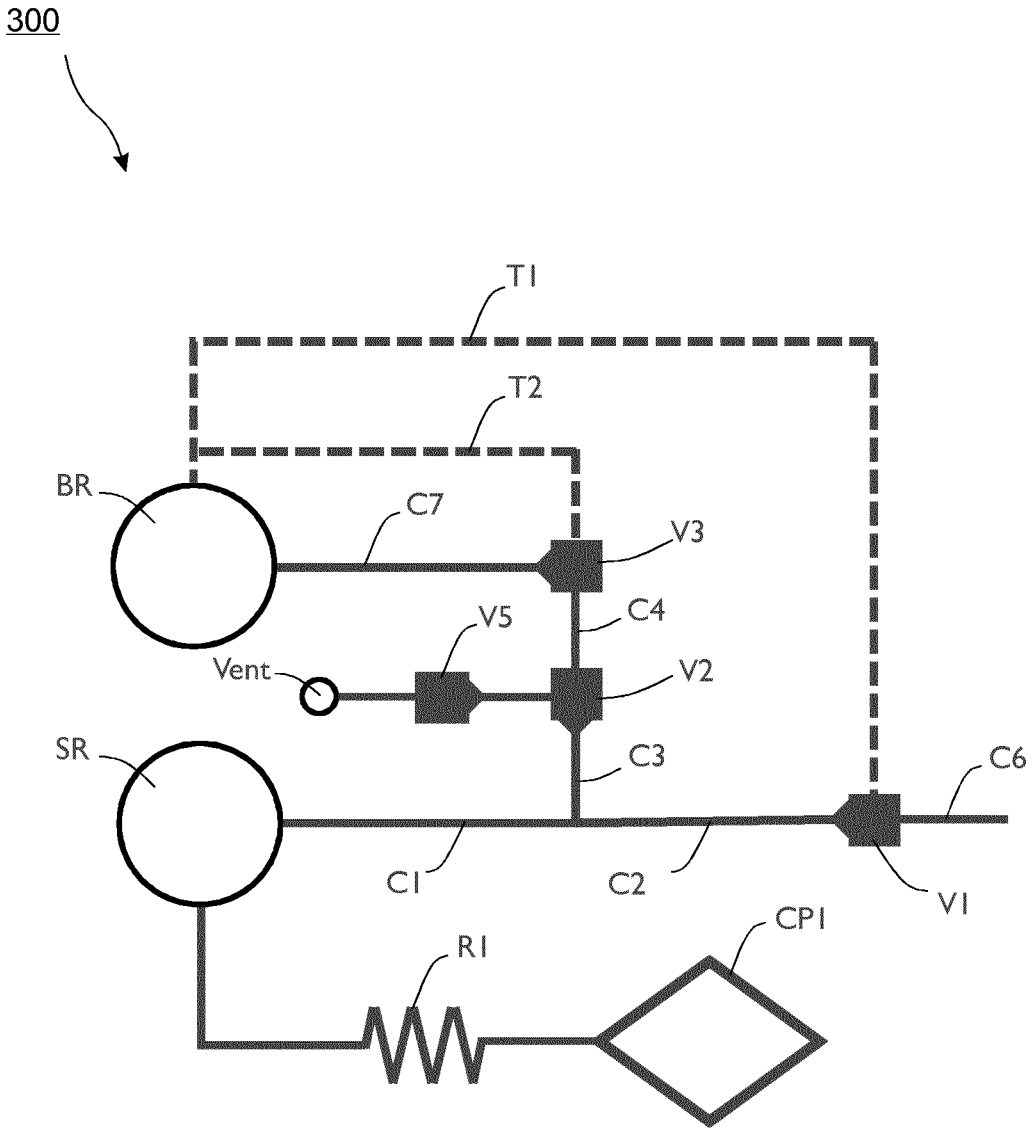
FIG. 4 shows a schematic circuit diagram of an arrangement in a capillary driven fluid system according to embodiments of the present disclosure.

Alternatively, a gas-tight top cover may be used. To allow gas to escape in such a case, one or more vents may be used instead. FIG. 4 shows an arrangement 300 utilizing such a scheme. The arrangement 300 differs from the arrangement 200 in that the gaseous communication with surroundings occurs through a further valve V5 fluidically connected to the second valve V2. The further valve V5 allows gas to pass while blocking liquids. The excess air is ventilated to the surroundings through a vent. Such a vent could be for example a small nozzle or hole.

Figure 5:
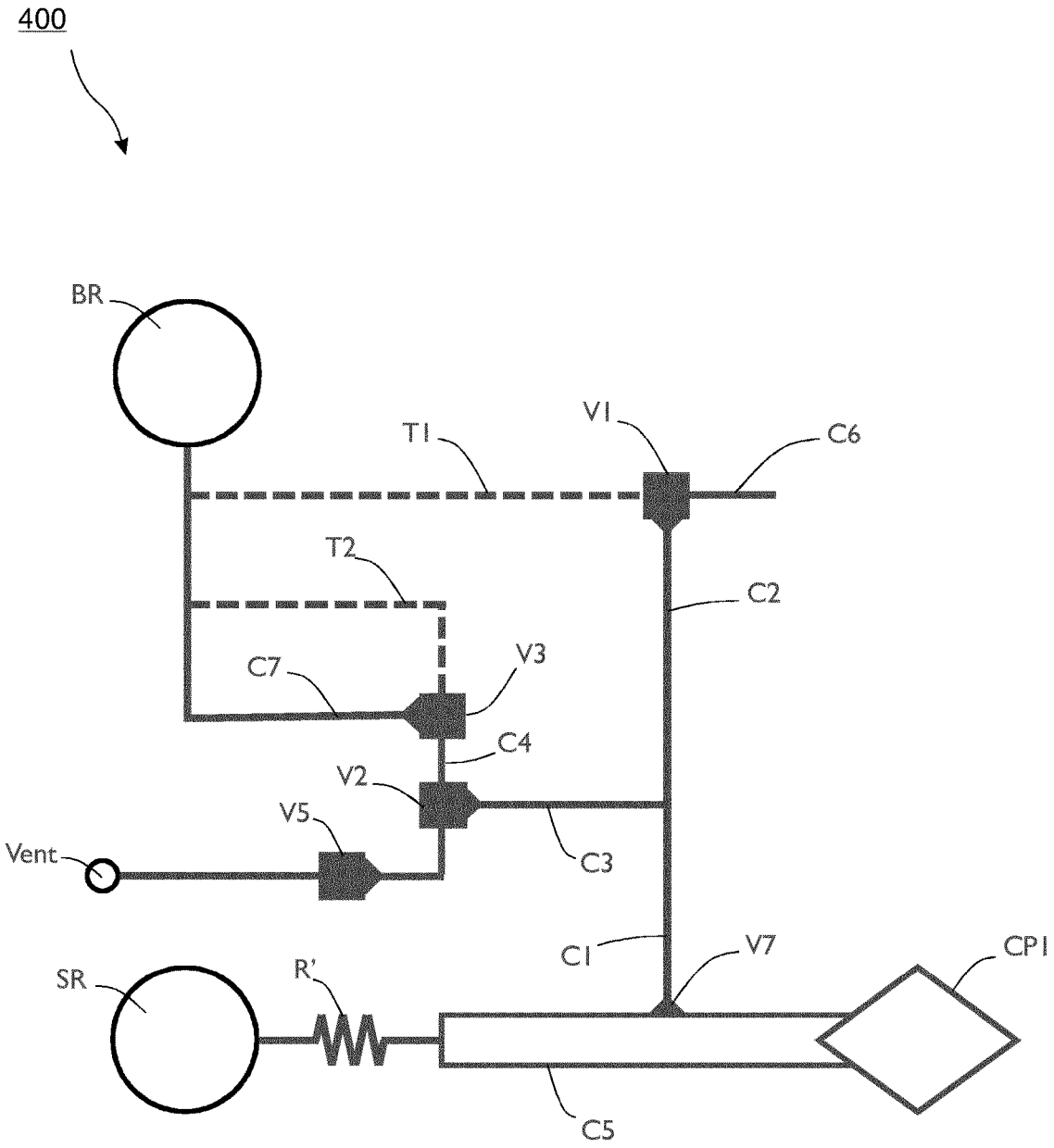
FIG. 5 shows a schematic circuit diagram of an arrangement in a capillary driven fluid system according to embodiments of the present disclosure.

The embodiments of the arrangement shown in FIGS. 1, 3 and 4 rely on the capillary pump CP1 fluidically communicating with the sample reservoir via a separate branch. FIG. 5 shows an arrangement 400 where the capillary pump CP1 and the first channel C1 rather have a common connection to the sample reservoir. It should be noted that the arrangement 400 differs from the arrangement 300 only in the way sample fluid is administered into the first channel C1. This alternative way administering fluid into the first channel C1 may of course also be implemented in the arrangements 100 and 200 of FIGS. 1 and 3.

The arrangement 400 further comprises a fifth channel C5 of lower capillary pressure than the first channel C1, second channel C2, and third channel C3. The first channel C1 is arranged as a branch to the fifth channel C5. In use, the first channel C1 is therefore arranged to draw fluid from the sample reservoir SR via the fifth channel C5. The capillary pump CP1 is fluidically connected to the sample reservoir SR via a path which includes the fifth channel C5 and which includes a flow restrictor R' such that the capillary pump CP1 is arranged to empty the sample reservoir SR via the fifth channel C5 after the second channel C2 and the third channel C3 have been filled with sample fluid. The capillary pressure of the capillary pump CP1 should be designed to be sufficient to suck the resistor R' and channel C5 dry of liquid after the sample reservoir SR is emptied. Valve V7 functions as a one-way capillary stop valve to prevent the backflow of liquid from the sample metering channels C2 and C3 through channel C1 into channel C5 once valves V1 and V2 are actuated. The one-way capillary stop valve V7 allows fluid to flow unimpeded from channel C5 into channel C1 but upon drying of channel C5, capillary forces prevent the fluid from flowing back through channel C1 into channel C5.

When in use, the arrangement 400 operates as follows: Sample is added to the sample reservoir SR and drawn through the flow restrictor R' into the fifth channel C5. The flow restrictor R' could, e.g., be in the form of a fluidic channel, the length of which causes a flow resistance. It could also be in the form of an orifice to the fifth channel C5, causing the flow to be restricted. The flow restrictor R' could also be included in the fifth channel C5 itself. For example, the fifth channel C5 could be designed to be of considerable length, thereby causing it to serve as a flow restrictor. The fifth channel C5 typically has a larger channel cross section than the other channels of the arrangement 400. A larger channel cross section results in a lower capillary pressure and hence a lower force exerted on the fluid within the channel. Because of the higher capillary pressure in the first channel C1 compared to the fifth channel C5 and because of the resistance of the flow restrictor R', the capillary flow preferentially fills the first channel C1 rather than continuing to fill the fifth channel C5.

After filling the first channel C1, the flow splits into the second channel C2 and the third channel C3. The channels C2 and C3 are designed to have a capillary pressure higher than the fifth channel C5 so that after filling the first channel C1, the capillary driven flow continues to fill the second channel C2 and the third channel C3 until the liquid vapor interface reaches the first valve V1 and the second valve V2. Once the capillary interface reaches the first valve V1 and the second valve V2, the flow of sample fluid stops proceeding in the branch consisting of the first channel C1, the second channel C2 and the third channel C3. Instead, the flow of sample fluid will restart in the fifth channel C5 until the fifth channel C5 is filled and the capillary interface reaches the capillary pump CP1. Meanwhile, the buffer fluid is added to the buffer reservoir BR. Capillary forces draw the buffer fluid into the second channel C2. After the second channel C2 is filled, the flow stops at the third valve V3. The function of the first control circuit T1 and the second control circuit T2 are the same as for the arrangement 300. The second control circuit, which may be a second fluidic circuit T2, is arranged to open the third valve V3. The buffer fluid then enters the fourth channel C4 and opens the second valve V2. The buffer fluid continues until it reaches the further valve V5 at which the flow stops. The first control circuit, which may be a first fluidic circuit T1, is arranged to open the first valve V1. Once the first valve V1 is opened, the sample fluid in the metered volume (i.e. the second channel C2 and the third channel C3) is drawn by capillary forces into the sixth channel C6 which is arranged for connecting the arrangement 400 to an external system. The second channel C2 and the third channel C3 are replenished by the buffer fluid as the sample fluid is transferred through the first valve V1 into the sixth channel C6.

Figure 6:
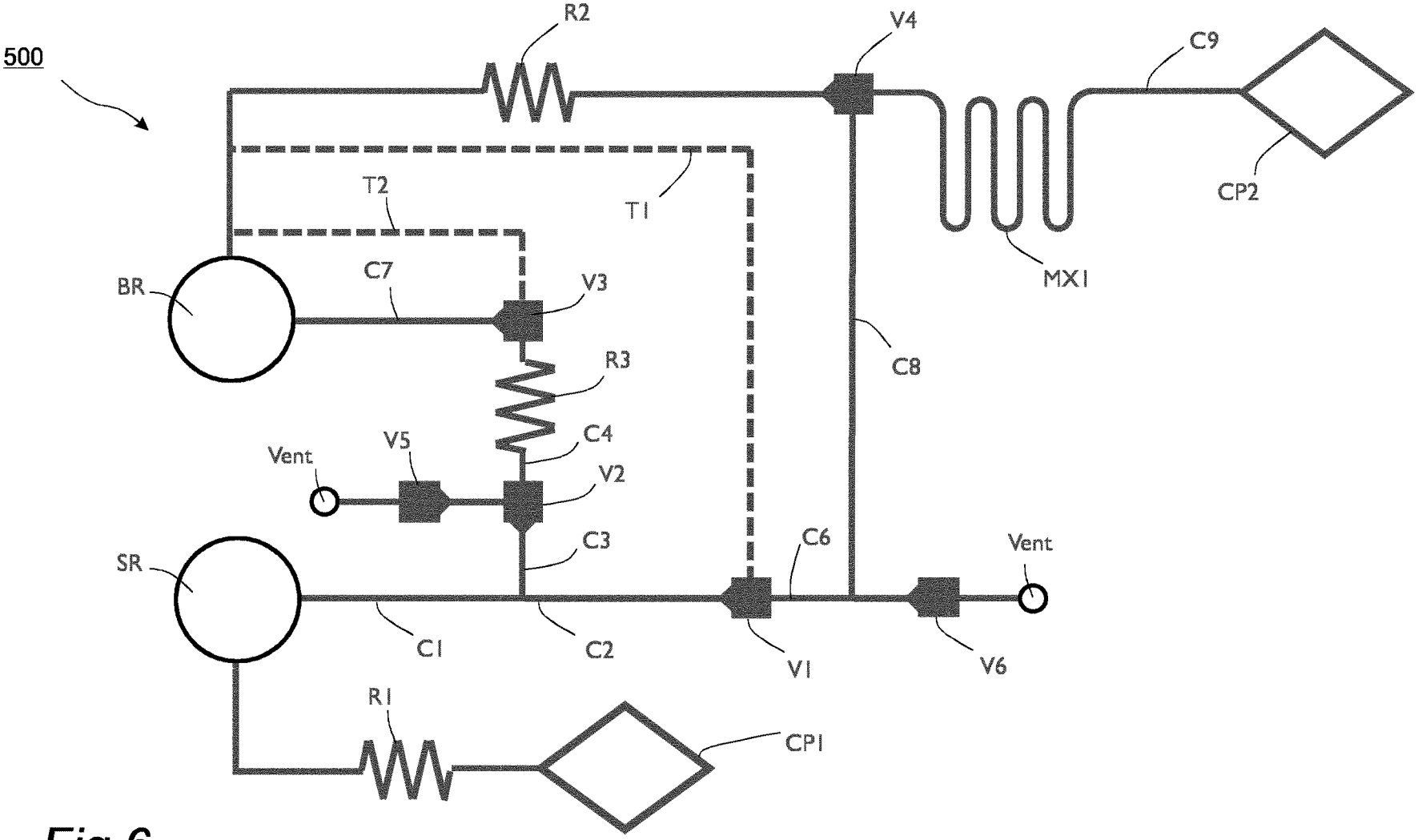
FIG. 6 shows a schematic circuit diagram of an arrangement according to embodiments of the present disclosure.

For some applications, it may be beneficial to dilute the sample fluid. Such applications may be for example blood cell counting where the undiluted sample is too dense to count individual blood cells. Dilution may be carried out after sample metering, but may advantageously be carried out as a sub step in the metering process. FIG. 6 shows an arrangement 500 capable of both metering and diluting a sample fluid. The arrangement 500 is based upon the arrangement 300 shown in FIG. 4 and the metering is carried out in the same way for both embodiments.

In the arrangement 500, the predetermined volume of sample fluid flowing out through the first valve V1 is received by a sixth channel C6 ending at a fourth valve V4. The fourth valve V4 is arranged to dilute the predetermined volume of sample fluid received from the sixth channel C6 with buffer fluid received from the buffer reservoir BR via a second flow resistor R2 so as to create a diluted sample fluid. The fourth channel C3 comprises a third flow resistor R3. With the arrangement, a ratio between a flow rate of sample fluid received from the sixth channel C6 and a flow rate of the buffer fluid received from the buffer reservoir BR is at least partly determined by a resistance of the second flow resistor R2 and a resistance of the third flow resistor R3. The mix ratio between the sample fluid in the sample reservoir and the buffer in the buffer reservoir is thus primarily determined by the resistance of second flow resistor R2 and the third flow resistor R3 assuming that the resistance of all other channels is negligible.

The arrangement 500 further comprises a mixer MX1 which is fluidically connected to an output of the fourth valve V5 and which is arranged to mix the diluted sample fluid. In practice, a variety of different mixers may be implemented such as a parallel lamination mixer, herringbone mixer, or serpentine channel. For capillary flow applications, the serpentine channel may be preferable due to its resilience against trapping air bubbles and simplicity of the design. The channel width of the serpentine channel mixer should be small enough to allow fast diffusion while the channel length should be sufficient to fully mix the fluid streams.

The arrangement 500 further comprises a further capillary pump CP2 in fluid communication with the mixer MX1 through a detection channel C9, the further capillary pump being arranged to sustain a flow rate of the diluted sample fluid through detection channel C9. The mixer MX1 is designed to mix the sample fluid with the buffer fluid so that the end result is a homogenous solution. The detection channel C9 is designed to allow measurement of the quantity of interest, e.g. counting of blood cells. The counting can be performed optically, electrically, or by other means. The further capillary pump CP2 sustains the flow rate for the period of time needed to perform the assay.

The arrangement 500 further comprises of an optional valve V6 with associated vent. This vent may be needed in cases where the hydraulic resistance of the mixer MX1 is large ($>10^{16}$ Pa*s/m$^3$) and air is unable to easily escape through MX1 and the capillary pump CP2. Note that, in practice, capillary pumps CP1 and CP2 are typically vented to atmosphere. However, if the hydraulic resistance of mixer MX1 is small, valve V6 and the associated vent can be omitted.

It should be understood that, although the fourth valve V4 is arranged to mix two fluids with each other, the fourth valve V4 may be of the same type as the valve type used for e.g. the first valve V1. For example, the valve type may be a microfluidic valve type, such as a capillary trigger valve type.

Actually, if using capillary trigger valves, the first valve V1 will also allow liquid from the main input and the control input to be mixed. The extent of mixing is controlled by the flow resistance at the two inputs. Specifically, for the first valve V1, the control input typically has considerably higher flow resistance (i.e. the connecting channel is relatively long and/or cross section relatively small) relative to the main input. This ensures that mixing between the buffer fluid and the sample fluid will be negligible. For the fourth valve V4, however, the flow resistance in the input channels are similar, thus resulting in the sample fluid and the buffer fluid both being allowed to pass the valve together.

The embodiments described herein are not limited to the above described examples. Various alternatives, modifications, and equivalents may be used. For example, further valves may be included, further improving the timing control of the arrangement. Furthermore, alternative valve technologies may be used. Therefore, this disclosure should not be limited to the specific form set forth herein. This disclosure is limited only by the appended claims and other embodiments than those mentioned above are equally possible within the scope of the claims.

The invention claimed is:

1. An arrangement (100) in a capillary driven fluid system for metering a predetermined volume of sample fluid, the arrangement comprising:

a sample reservoir (SR) arranged to receive a sample fluid, a first channel (C1) which is in fluid communication with the sample reservoir (SR) and which branches off into a second channel (C2) ending at a first valve (V1) and a third channel (C3) ending at a second valve (V2), wherein the second channel (C2) and the third channel (C3) together have a predetermined volume, and the first channel (C1) is arranged to draw sample fluid from the sample reservoir (SR) by use of capillary forces to fill the second channel (C2) and the third channel (C3) with the predetermined volume of sample fluid, a capillary pump (CP1) arranged to empty the sample reservoir (SR), a buffer reservoir (BR) arranged to receive a buffer fluid, a fourth channel (C4), wherein the second valve (V2) is fluidically connected to the buffer reservoir (BR) via the fourth channel (C4), the fourth channel (C4) being arranged to draw buffer fluid from the buffer reservoir (BR) by use of capillary forces after the sample reservoir (SR) has been emptied, and to open the second valve (V2) as buffer fluid in the fourth channel (C4) reaches the second valve (V2), whereby a fluid path including the fourth channel (C4), the third channel (C3) and the second channel (C2) is opened up from the buffer reservoir (BR) to the first valve (V1), wherein the capillary pump (CP1) is arranged to empty the sample reservoir (SR) after the second channel (C2) and the third channel (C3) have been filled with sample fluid, and before the buffer fluid in the fourth channel (C4) reaches the second valve (V2)

and a first control circuit (T1) comprising a first fluidic circuit which fluidically connects the first valve (V1) to the buffer reservoir (BR), the first fluidic circuit being arranged to draw buffer fluid from the buffer reservoir (BR) and open the first valve (V1) as buffer fluid reaches the first valve (V1), the first control circuit being arranged to open the first valve (V1) after the sample reservoir (SR) has been emptied, whereby a capillary driven flow arises in said fluid path, thereby causing the predetermined volume of sample fluid in the second (C2) and third (C3) channels to flow out through the first valve (V1).

2. The arrangement according to claim 1, further comprising:

a third valve (V3) fluidically connected to the fourth channel (C4) such that buffer fluid drawn from the buffer reservoir (BR) passes through the third valve (V3) before entering the fourth channel (C4), and a second control circuit (T2) which is arranged to open the third valve (V3) after the sample reservoir (SR) has been emptied.

3. The arrangement according to claim 2, wherein the second control circuit (T2) comprises a second fluidic circuit which fluidically connects the third valve (V3) to the buffer reservoir, the second fluidic circuit being arranged to draw buffer fluid from the buffer reservoir (BR) and open the third valve (V3) as buffer fluid reaches the third valve (V3).

4. The arrangement according to claim 2, wherein the at least one of the first control circuit (T1) and the second control circuit (T2) is arranged to deliver an electrical control signal to at least one of the first valve (V1) and the second valve (V2), wherein the at least one of the first valve (V1) and the second valve (V2) is arranged to open upon receipt of the electrical signal.

5. The arrangement according to claim 2, wherein the first control circuit (T1) is arranged to open the first valve (V1) simultaneously with or after an opening of the second valve (V2).

6. The arrangement according to claim 1, wherein the first channel (C1) is fluidically connected to the sample reservoir (SR) so as to draw sample fluid directly from the sample reservoir, and wherein the capillary pump (CP1) is fluidically connected to the sample reservoir (SR) via a first flow resistor (R1), wherein the first flow resistor (R1) has a flow resistance which is selected to control the flow rate from the sample reservoir (SR) to the capillary pump (CP1) such that the sample reservoir (SR) is emptied after the second (C2) and third (C3) channels have been filled with sample fluid.

7. The arrangement according to claim 1, further comprising a fifth channel (C5) of lower capillary pressure than the first channel (C1), wherein the first channel (C1) is arranged as a branch to the fifth channel (C5) such that the first channel (C1) is arranged to draw fluid from the sample reservoir (SR) via the fifth channel (C5), wherein the capillary pump (CP1) is fluidically connected to the sample reservoir (SR) via a path which includes the fifth channel (C5) and which includes a flow restrictor (R') such that the capillary pump (CP1) is arranged to empty the sample reservoir (SR) via the fifth channel (C5) after the second channel (C2) and the third channel (C3) have been filled with sample fluid.

8. The arrangement according to claim 1, wherein the sample fluid and/or the buffer fluid at least partly is in gaseous communication with surroundings of the arrangement such as to allow gas mixed within the sample fluid and/or buffer fluid to escape from the arrangement.

9. The arrangement according to claim 8, wherein the gaseous communication with surroundings occur through a gas permeable sheet.

10. The arrangement according of claim 9, wherein the gaseous communication with surroundings occurs through one or more further valves (V5, V6) fluidically connected to one or more from: the first valve (V1) and the second valve (V2), said one or more further valves (V5, V6) being arranged to allow gas to pass while blocking liquids.

11. The arrangement according to claim 1, wherein the predetermined volume of sample fluid flowing out through the first valve (V1) is received by a sixth channel (C6) ending at a fourth valve (V4), wherein the fourth valve (V4) is arranged to dilute the predetermined volume of sample fluid received from the sixth channel (C6) with buffer fluid received from the buffer reservoir (BR) via a second flow resistor (R2) so as to create a diluted sample fluid, wherein the fourth channel (C4) comprises a third flow resistor (R3), and wherein a ratio between a flow rate of sample fluid received from the sixth channel (C6) and a flow rate of the buffer fluid received from the buffer reservoir (BR) is at least partly determined by a resistance of the second flow resistor (R2) and a resistance of the third flow resistor (R3).

12. The arrangement according to claim 7, further comprising a mixer (MX1) which is fluidically connected to an output of a fourth valve (V4) and which is arranged to mix the diluted sample fluid, and a further capillary pump (CP2) in fluid communication with the mixer (MX1), the further capillary pump being arranged to sustain a flow rate of the diluted sample fluid through the mixer (MX1).

13. A method for metering a predetermined volume of sample fluid, the method comprising the steps of:

adding (S102) sample fluid to a sample reservoir (SR), setting (S104) a first channel (C1) in fluid communication with the sample reservoir, such that the first channel (C1) draws sample fluid from the sample reservoir, by use of capillary forces, to fill a second channel (C2) and a third channel (C3), which are branches of the first channel (C1), with a predetermined volume of sample fluid, wherein the second channel (C2) ends at a first valve (V1) and the third channel (C3) ends at a second valve (V2), after the second channel (C2) and the third channel (C3) have been filled with the predetermined volume of sample fluid: emptying (S106) the sample reservoir (SR) by removing sample fluid using a capillary pump (CP1), after the sample reservoir (SR) has been emptied: setting (S108) the second valve (V2) in fluid communication with a buffer reservoir (BR) filled with buffer fluid via a fourth channel (C4), such that the fourth channel (C4) draws buffer fluid from the buffer reservoir (BR) by use of capillary forces, and opens the second valve (V2) as buffer fluid in the fourth channel (C4) reaches the second valve (V2), whereby a fluid path including the fourth channel (C4), the third channel (C3) and the second channel (C2) is opened up from the buffer reservoir (BR) to the first valve (V1), and opening (S110), by a first control circuit (T1), the first valve (V1), whereby a capillary driven flow arises in said fluid path, thereby causing the predetermined volume of sample fluid in the second (C2) and third channels (C3) to flow out through the first valve (V1).

14. A diagnostic device comprising the arrangement according to claim 1.

* * * * *